US005655238A

United States Patent [19]

Stickley et al.

[11] Patent Number: 5,655,238

[45] Date of Patent: Aug. 12, 1997

[54] EXTREME POSITION SURGERY TABLE TOP ATTACHMENT

[75] Inventors: Keith A. Stickley, Greenville; James A. Schaefer, Versailles, both of Ohio

[73] Assignee: Midmark Corporation, Versailles, Ohio

[21] Appl. No.: 628,032

[22] Filed: Apr. 5, 1996

[51] Int. Cl.[6] ..... A61G 13/04; A61G 13/10; A61G 13/12

[52] U.S. Cl. ..... 5/618; 5/621; 5/624

[58] Field of Search ..... 5/621, 618, 610, 5/611, 612, 622, 624, 651, 648, 600, 632; 108/90

[56] References Cited

U.S. PATENT DOCUMENTS

| | | | |
|---|---|---|---|
| 1,203,752 | 11/1916 | Claire | 108/90 |
| 2,175,572 | 10/1939 | Ruhl | 108/90 |
| 2,680,046 | 6/1954 | Stava . | |
| 2,735,738 | 2/1956 | Berne . | |
| 2,897,029 | 7/1959 | Maisel | 5/621 |
| 3,372,921 | 3/1968 | Anderson | 5/624 |
| 3,754,749 | 8/1973 | Lyon et al. . | |
| 4,021,028 | 5/1977 | Weber et al. . | |
| 4,045,078 | 8/1977 | Shine . | |
| 4,148,472 | 4/1979 | Rais et al. . | |
| 4,186,917 | 2/1980 | Rais et al. . | |
| 4,603,845 | 8/1986 | Schmedemann . | |
| 4,749,177 | 6/1988 | Schäfer et al. . | |
| 4,872,657 | 10/1989 | Lüssi . | |
| 5,083,331 | 1/1992 | Schnelle et al. | 5/600 |
| 5,148,562 | 9/1992 | Borders et al. | 5/610 |
| 5,149,074 | 9/1992 | Jarin | 5/601 |
| 5,299,334 | 4/1994 | Gonzalez | 5/607 |
| 5,317,769 | 6/1994 | Weismiller et al. | 5/610 |
| 5,345,632 | 9/1994 | Langenaeken et al. | 5/601 |
| 5,475,884 | 12/1995 | Kirmse et al. | 5/600 |
| 5,477,570 | 12/1995 | Mannant et al. | 5/600 |
| 5,564,662 | 10/1996 | Lüssi et al. | 5/600 |

*Primary Examiner*—Alexander Grosz
*Attorney, Agent, or Firm*—Biebel & French

[57] ABSTRACT

A surgery table including a table top attachment providing for extreme angular positioning of a patient. The surgery table includes a base supporting a support column, and an articulated patient support portion pivotally attached to an upper end of the column. The table top attachment is attached to an articulated section of the table for movement with the articulated section whereby the attachment may be positioned at an extreme reverse Trendelenburg position. When the attachment is detached from the surgery table, the surgery table may be used in a conventional manner to position a patient in a plurality of articulated positions.

12 Claims, 5 Drawing Sheets

EXTREME POSITION SURGERY TABLE TOP ATTACHMENT

BACKGROUND OF THE INVENTION

The present invention relates generally to a surgery table, and more particularly, to a surgery table including a table top attachment which facilitates extreme positioning of a patient supported on the surgery table.

Medical surgery tables are generally constructed such that operating personnel may position the table in a plurality of different configurations. Several known surgical tables are formed with articulated sections which are movable relative to each other in order to provided the different configurations, and the operator may selectively move the sections relative to each other to obtain a particular configuration for performing a selected operation.

While it is possible to construct a surgery table which is capable of being positioned into a plurality of configurations, certain design constraints generally preclude providing a table which can accommodate all of the desired surgical positions for a patient. For example, in certain operations it is desirable to obtain an extreme reverse Trendelenburg position for the table. Such a position may be desirable for operations involving obese patients wherein the extreme reverse Trendelenburg position facilitates use of gravity to move the patent's organs to a desired position during surgery. Generally surgery tables do not provide for extreme Trendelenburg positions in that the geometry underlying the design of the tables is such that the extreme positioning is not compatible with the other configurations of the table.

SUMMARY OF THE INVENTION

The present invention provides a surgery table including a table top attachment which facilitates positioning of a patient on the surgery table in an extreme reverse Trendelenburg position.

In one aspect, the invention comprises a surgery table having a base for supporting the surgery table on a floor surface. A support column extends upwardly from the base and includes an upper end supporting a first support section. The first support section is attached to the support column for pivotal movement relative to the support column, and has an upper portion for supporting a patient thereon. A second support section is attached to the first support section wherein the second support section is pivotally movable relative to the first support section, and also includes an upper portion for supporting a patient thereon.

A table top attachment is attached to the second support section and extends over the upper portion of the second support section as well as over the upper portion of the first support section. The table top attachment includes a substantially planar upper surface for supporting a patient thereon. The first and second support sections are movable to position the upper surface of the attachment at an angle of approximately 60 degrees relative to horizontal to thereby provide an extreme reverse Trendelenburg position.

The attachment includes engagement portions located on opposing lateral sides thereof wherein the engagement portions are defined by downwardly extending plates. The plates are adapted to engage side rail portions of the second support section whereby the attachment is clamped to the surgery table in a detachable manner. When the attachment is removed from the second support section, the upper portions of the first and second support sections are exposed for supporting a patient.

A foot rest is also provided for positioning substantially perpendicular to the upper surface of the attachment. The foot rest includes mounting bars for engaging clamps attached to side rails of the table top attachment. The foot rest may be adjustably positioned longitudinally along the table top attachment.

Therefore, it is an object of the present invention to provide a surgery table capable of positioning a patient in an extreme position, such as an extreme reverse Trendelenburg position.

It is a further object of the invention to provide a surgery table having an articulated top and a table top attachment attached thereto for providing an extreme patient positioning capability.

It is yet another object of the invention to provide an attachment for a surgery table which may be detachably engaged with a patient supporting table top of the surgery table.

Other objects and advantages of the invention will be apparent from the following description, the accompanying drawings and the appended claims.

DETAILED DESCRIPTION OF THE PREFERRED EMBODIMENT

Figure 1:
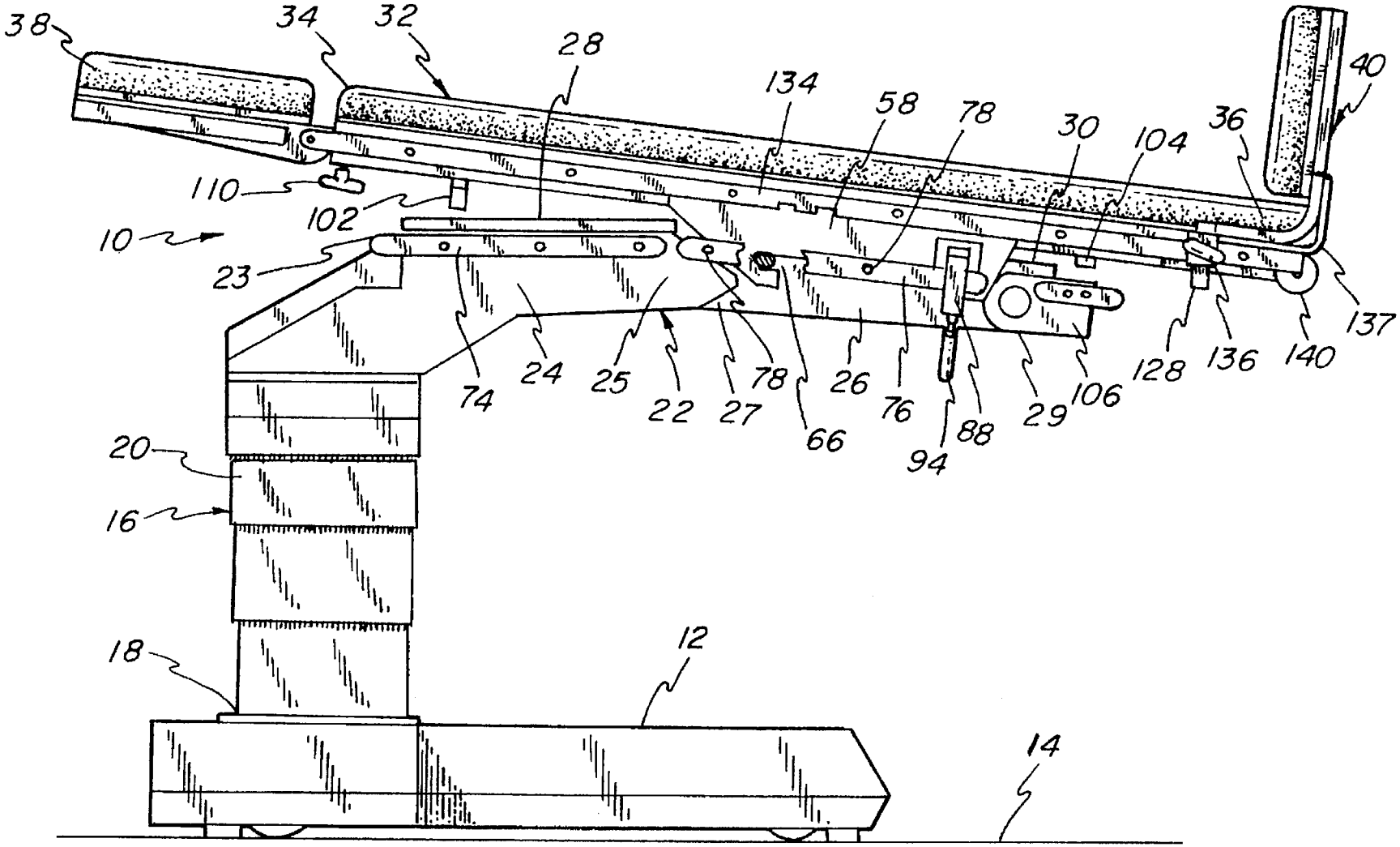
FIG. 1 is an elevational view showing the surgery table with the table top attachment positioned thereon in a substantially horizontal position.
Figure 2:
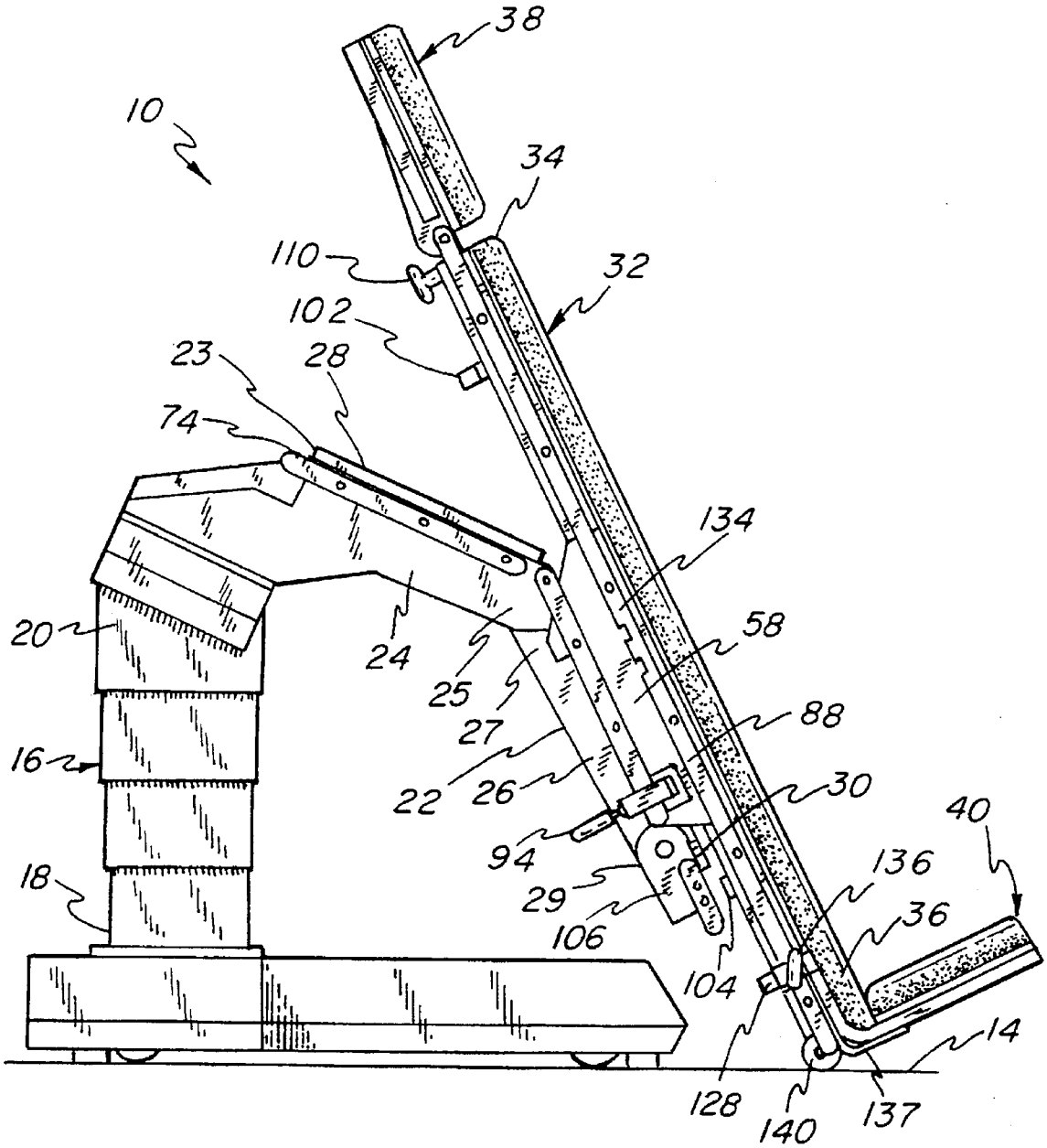
FIG. 2 is an elevational view of the surgery table with the table top attachment positioned in an extreme reverse Trendelenburg position.

Referring initially to FIGS. 1 and 2, the surgery table 10 of the present invention generally includes a base 12 for supporting the table on a floor surface 14 and a support column 16 having a lower end 18 attached to the base 12 and an upper end 20 supporting a patient support portion 22. The column 16 is formed of a plurality of telescoping sections movable relative to each other to adjust the vertical position of the patent support portion 22 relative to the base 12.

The patient support portion 22 includes a first support or back section 24 attached to the column 16 at a first end 23 of the first section 24 for pivotal movement relative to the upper end 20. A first end 27 of a second support or seat section 26 is attached to a second end 25 of the first support section 24 and is capable of pivotal movement relative to the first support section 24. The first support section 24 includes an upper portion 28 defining a surface for supporting a patient, and the second support section 26 similarly includes an upper support portion 30 defining a surface for supporting a patient. Thus, the patient support portion 22 is configured as an articulated patient support extending in cantilever relation from the upper end 20 of the support column 16, and the support portion 22 extends over the base 12 such that the base 12 is positioned to counteract any tipping forces which may be exerted by a patient supported on the support portion 22. It should be noted that the surgery table structure thus far described is substantially the same as that disclosed in co-pending U.S. patent application Ser. No. 08/290,384, assigned to the assignee of the present application, and incorporated herein by reference.

A table top attachment 32 is mounted to the second support section 26 and includes a substantially planar upper surface for supporting a patient thereon. The support 32 includes a first end 34 which extends longitudinally beyond the first end 23 of the first support section 24, and a second end 36 which extends longitudinally outwardly beyond a second end 29 of the second support section 26. In addition, a head rest 38 is detachably attached to the first end 34 of the attachment 32 and a foot rest 40 is detachably attached at the second end 36 of the attachment 32, as will be described further below.

Figure 3:
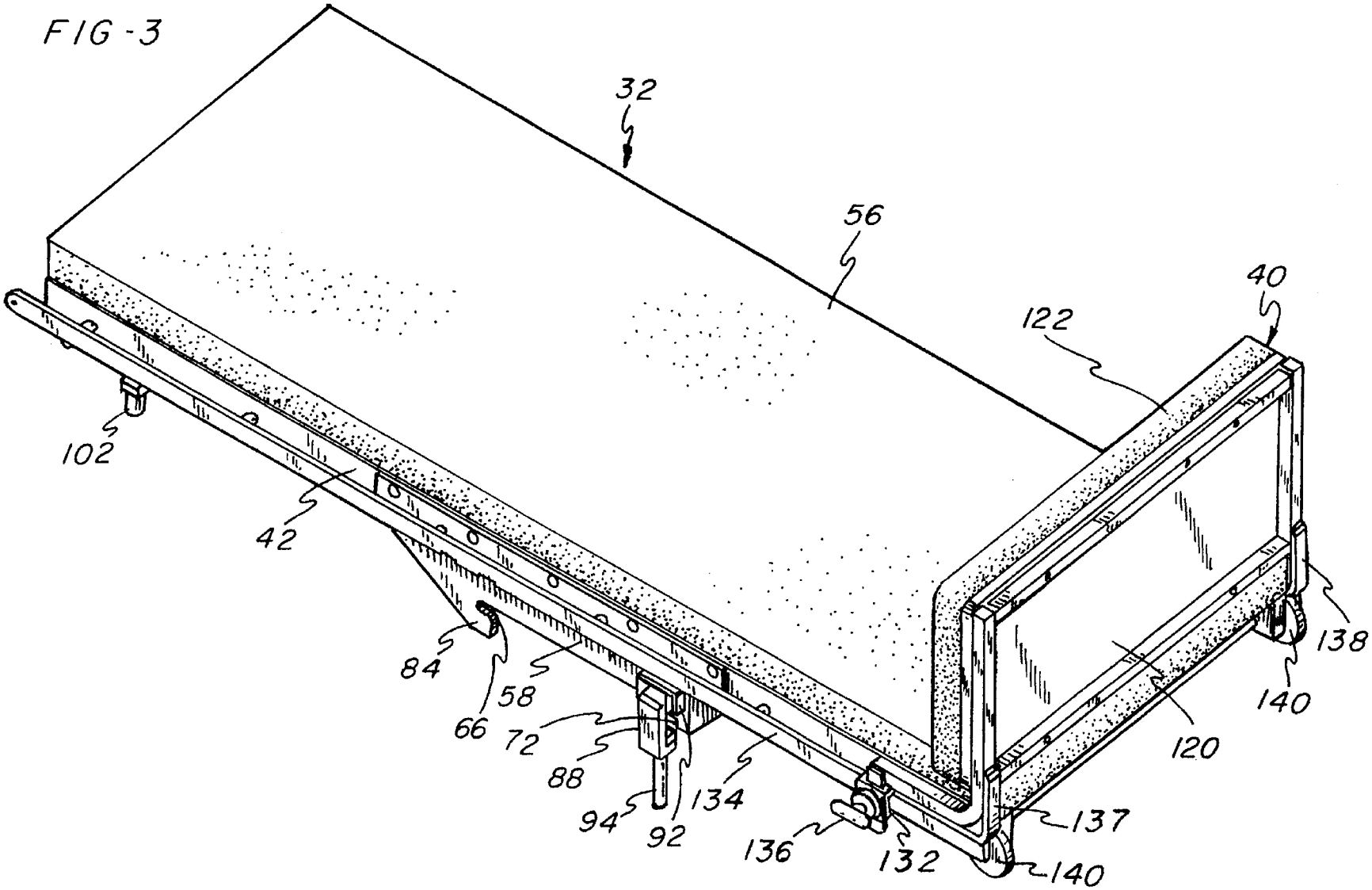
FIG. 3 is a top perspective view of the table top attachment with the foot rest attached.
Figure 4:
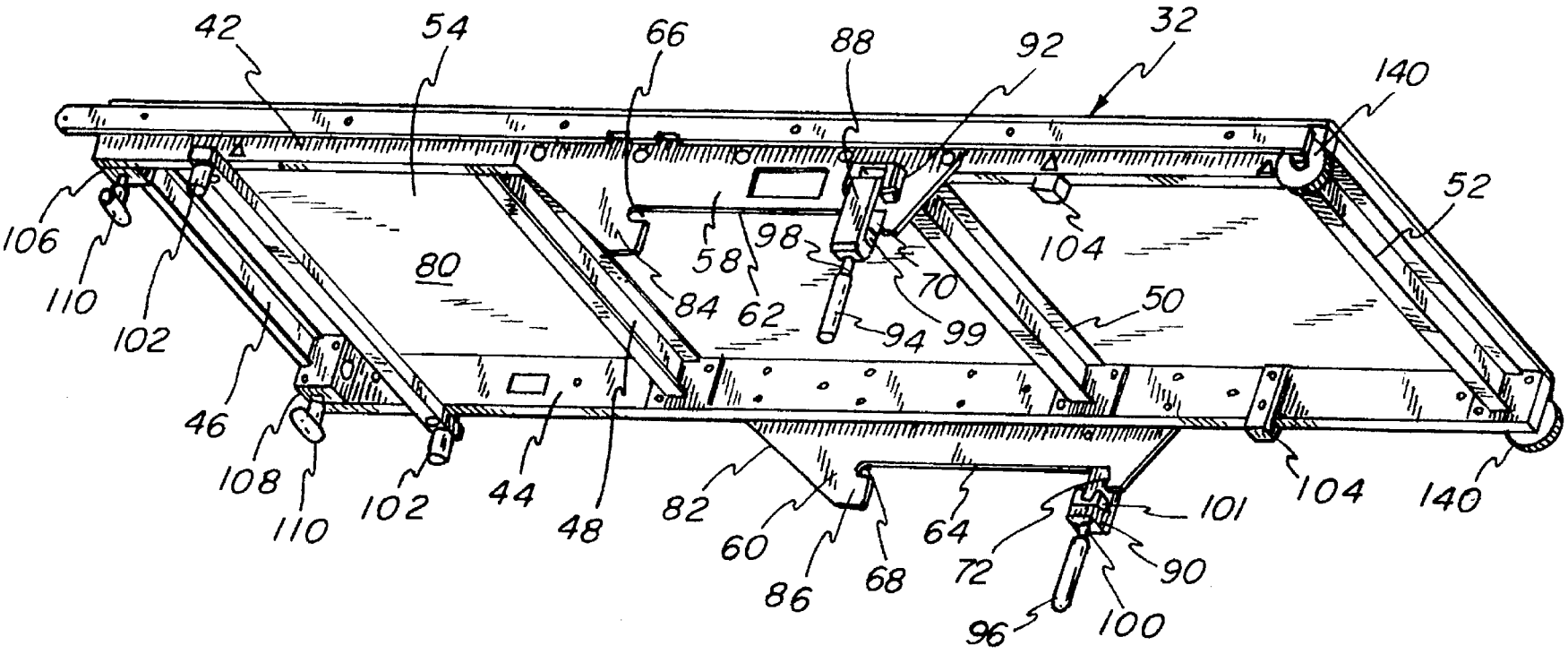
FIG. 4 is a bottom perspective view of the table top attachment.

Referring to FIGS. 3 and 4, the table top attachment 32 includes a support frame defined by opposed longitudinal members 42, 44 connected by a plurality of lateral members 46, 48, 50, 52. A support plate 54 is supported on the frame, and a cushion 56 is positioned on the support plate 54 to define the upper support surface for supporting a patient thereon. A pair of engagement plates 58, 60 are attached to and extend downwardly from respective longitudinal members 42, 44 to define engagement portions for engaging the second support section 26. Each of the plates 58, 60 includes a cut out lower portion 62, 64, including a slot 66, 68 located at a forward end thereof and a vertical edge 70, 72 located at a rearward end thereof.

Referring further to FIG. 1, the first and second support sections 24, 26 include accessory support rails 74, 76, respectively, supported on opposing side portions of the support sections 24, 26. The rail 76 is partially cut away to show a typical support post 78 for supporting the rail 76 in spaced relation to the side portions of the table. As may be seen in this view, the post 78 is engaged within the slot 66. In addition, forward edges 80, 82 of the plates 58, 60 ate angled rearwardly in a downward direction to facilitate passage of downwardly extending tabs 84, 86 between adjacent posts 78. The tabs 84, 86 and slots 66, 68 define hook portions for extending around the posts 78 to facilitate clamping the plates 58, 60 to the second support section 26.

The rearwardly located vertical edges 70, 72 of the plates 58, 60 are adapted to engage posts 78 adjacent to rearward ends of the rails 76. Thus, engagement between the plates 58, 60 and the posts 78 prevent longitudinal movement of the table top attachment 32 relative to the second support section 26.

A pair of C-clamps 88, 90 are mounted to the plates 58, 60 adjacent to the rear ends thereof. The C-clamps 88, 90 are pivotally mounted to the respective plates 58, 60 at pivot points 92. The C-clamps 88, 90 also include respective drop handles 94, 96 for rotating screw members 98, 100 into the C-clamps 88, 90. It should be noted that the handles 94, 96 are pivotally connected to the screw members 98, 100 such that they may be pivoted to a position perpendicular to the longitudinal axis of the screw members 98, 100 when in use and permitted to hang downwardly when not in use. As the screw members 98, 100 are screwed upwardly, clamp blocks 99, 101 on the C-clamps 88, 90 are caused to engage the lower edges of the side rails 76 to thereby prevent the attachment 32 from being lifted from the second support section 26. Thus, the C-clamps 88, 90 act in combination with the post engaging portions 66, 68 and 70, 72 to positively engage the side rails 76 and thereby maintain the table top attachment 32 immovably clamped in place on the support portion 22.

As seen in FIG. 1, the table top attachment 32 is substantially parallel to the upper support surface 30 of the second support section 26, and the second support section 26 is pivoted slightly downwardly from the first support section 24 to ensure that the upper support portion 28 of the first support section 24 does not interfere with the attachment 32. Further, the attachment 32 is provided with bumpers 102 (FIG. 4) which are positioned to engage the side rails 74 of the first support section 24 in the event that the attachment 32 is inadvertently moved toward engagement with the first support section 24. In addition, a pair of stops 104 are also located on lower edges of the longitudinal frame members 42, 44 for engagement with leg pivot members 106 pivotally mounted to the second end 29 of the second support section 26. The leg pivot members 106 are normally used with the articulated table to pivotally support a leg section at the end of the second support section 26 when the table 10 is used without the attachment 32. The stops 104 limit upward pivotal movement of the members 106 in the event that the members 106 are inadvertently actuated for movement.

Referring further to FIG. 4, the first end 34 of the attachment 32 includes a pair of socket blocks 106, 108 defining sockets for receiving pin portions of the head rest 38. When the pin portions of the head rest 38 are located within the socket blocks 106, 108, T-handles 110 threadably engaged within the blocks 106, 108 may be rotated into frictional engagement with the pin portions located therein to thereby retain the head rest 38 in position.

Figure 5:
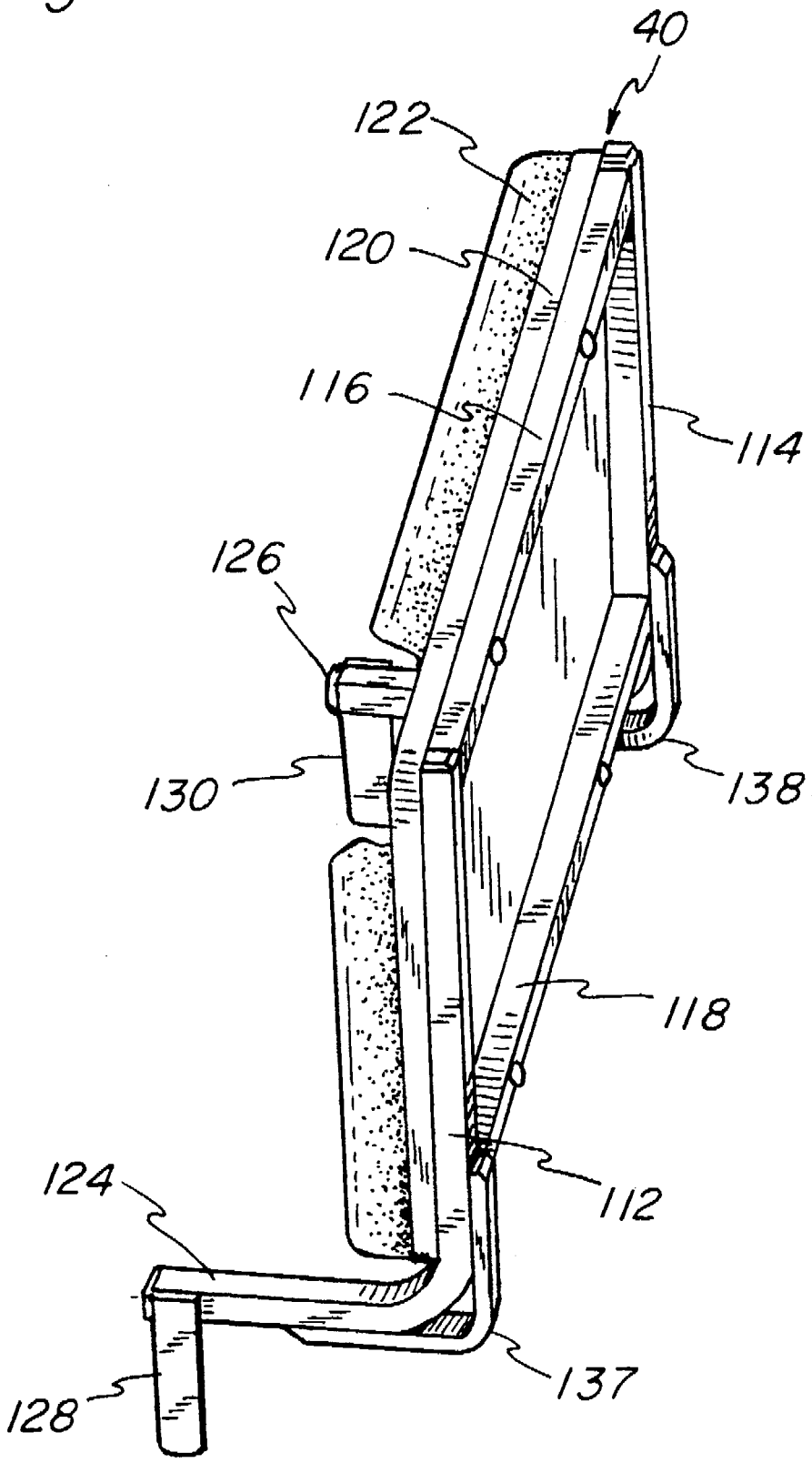
FIG. 5 is a perspective view of the foot rest for use with the table top attachment.

Referring to FIGS. 3 and 5, the foot rest 40 includes a frame defined by angled side members 112, 114 and lateral members 116, 118. The frame supports a foot rest board 120 and a cushion 122 for engagement with a patient's feet. Distal ends 124, 126 of the side members 112, 114 support mounting bars 128, 130 for engagement with respective side rail clamps 132 (FIGS. 1 and 2) mounted to side rails 134 supported along opposing edges of the table top attachment 32. The side rail clamps 132 are of a conventional design including a slot for receiving a mounting bar 128, 130 therethrough and a T-handle 136 for tightening down on a respective mounting bar 128, 130 to thereby clamp the mounting bar 128, 130 to the side rail 134. Thus, the foot rest 40 may be positioned longitudinally along the side rails 134 to obtain a desired position for the foot rest along the length of the attachment 32. In order to facilitate maintaining the foot rest 40 in substantially perpendicular relationship relative to the upper surface 56 of the attachment 32, the foot rest 40 is provided with contact bars 137, 138 which are adapted to rest on the side rails 134.

In attaching the table top attachment 32 to the surgery table 10, the surgery table 10 is initially leveled and any cushions are removed from the support portion 22. In addition, if a head section is attached to the first end 23 of the first support section 24 this head section is removed. Similarly, if a leg section is attached to the pivot members 106 at the end of the second support section 24 this leg section is also removed. Subsequently, the second section 26 is pivoted downwardly approximately 5 to 10 degrees such that it is positioned at an angle relative to the first support section 24.

The table top attachment 32 may then be lifted into place to engage the slots 66, 68 of the plates 58, 60 with the side rail posts 78, and the foot end of the attachment 32 is then moved downwardly with the C-clamps 88, 90 pivoted outwardly to clear the side rails 76 to position the vertical edges 70, 72 in engagement with rewardly located side rail posts 78. The C-clamps 88, 90 are then pivoted into position over the side rails 76 and are tightened into clamping engagement therewith to thereby positively clamp the attachment 32 into location on the second support section 26.

After the foot rest 40 is placed in position on the attachment 32, the patient may be placed on the table in preparation for an operation requiring reverse Trendelenburg positioning of the patient.

The table is actuated for movement to the reverse Trendelenburg position by initially actuating the column 16 to raise the support portion 22 to its fully raised height. Next the first support section 24 and second support section 26 are actuated such that the first support section 24 is pivoted approximately 20 degrees relative to the column 16 and the second support section 26 is pivoted approximately 40 degrees relative to the first support section 24 to place the attachment 32 at an angle of approximately 60 degrees. The movement of the table is continued until a pair of wheels 140 located at the foot end of the attachment 32 engage the floor 14 to thereby provide a further support for the lower end of the patient support.

From the above description, it should be apparent that the present invention provides a convenient means of supporting a patient in an extreme reverse Trendelenburg position of approximately 60 degrees using an articulated surgery table which is further adapted to support patients in a plurality of other positions. In addition, it should be noted that although the extreme position described for this invention places a patient at an angle of 60 degrees, the particular angle of the patient support may be altered to provide slightly greater or lesser angles which still provide extreme angular positioning of a patient which has hitherto not been possible with existing surgery tables.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An extreme position surgery table comprising:

a base for supporting said surgery table on a floor surface;

a support column having an upper end and a lower end attached to said base;

a first support section attached to said support column for pivotal movement relative to said support column, said first support section including an upper portion for supporting a patient thereon;

a second support section attached to said first support section for pivotal movement relative to said first support section, said second support section including an upper portion for supporting a patient thereon;

a table top attachment attached to said second support section and extending over said upper portion of said second support section and said upper portion of said first support section, said table top attachment including a substantially planar upper surface for supporting a patient; and wherein said table top attachment is removably attached to said second support section such that removal of said table top attachment exposes said upper portions of said first and second support sections for supporting a patient.

2. The surgery table as recited in claim 1 wherein said upper surface of said table top attachment extends substantially parallel to said upper portion of said second support section.

3. The surgery table as recited in claim 1 wherein said second support section includes a first end attached to said first support section and a second end distal from said first end, and said table top attachment includes a foot end extending outwardly beyond said second end of said second support section.

4. The surgery table as recited in claim 3 wherein said table top attachment includes a head end extending outwardly beyond said first support section.

5. The surgery table as recited in claim 1 wherein said first and second support sections are movable to position said upper surface of said table top attachment at an angle of approximately 60 degrees relative to horizontal.

6. The surgery table as recited in claim 1 wherein said second support section includes sides and side rails attached to said sides, said table top attachment including clamping members for engaging said side rails to thereby hold said table top attachment in engagement with said second support section.

7. An extreme position surgery table comprising:

a base for supporting said surgery table on a floor surface;

a support column having an upper end and a lower end attached to said base;

a patient support attached to said upper end of said support column for pivotal movement relative to said support column, said patient support having at least two articulated sections including an upper portion defining a surface for supporting a patient; a table top attachment attached to one of said articulated sections, said table top attachment including a substantially planar upper surface for supporting a patient, and said table top attachment is supported for movement with said one of said articulated sections whereby said table top attachment is movable to an extreme angular position relative to horizontal; and wherein said table top attachment is removably attached to said patient support such that removal of said table top attachment exposes said upper portion for supporting a patient.

8. The surgery table as recited in claim 7 wherein said table top attachment extends over a plurality of said articulated sections.

9. The surgery table as recited in claim 8 wherein said articulated sections extend outwardly in cantilever relation to said support column.

10. The surgery table as recited in claim 7 wherein said patient support is pivotal to position said table top attachment at an angle of approximately 60 degrees relative to horizontal.

11. The surgery table as recited in claim 7 wherein said patient support includes side rails and said table top attachment includes downwardly extending engagement portions for engaging said side rails to thereby attach said table top attachment to said patient support.

12. The surgery table as recited in claim 7 wherein said at least two articulated sections include a first section attached to said support column and a second section attached to said first section, said first and second sections being pivotally moveable to position said table top attachment in said extreme angular position.

* * * * *